United States Patent [19]

Tikkanen

[11] Patent Number: 4,999,088

[45] Date of Patent: Mar. 12, 1991

[54] NO-BOX SYSTEM WITH BOOSTER HEAD SPRAY FOR DELIVERING PAPER STOCK TO A PAPER MACHINE

[76] Inventor: Tim Tikkanen, Apt. 1008 Minerva, Benalmadena, Malaga, Spain

[21] Appl. No.: 380,375

[22] Filed: Jul. 17, 1989

Related U.S. Application Data

[63] Continuation-in-part of Ser. No. 341,843, Apr. 24, 1989, abandoned.

[51] Int. Cl.[5] ..... D21F 1/00

[52] U.S. Cl. ..... 162/317; 162/339

[58] Field of Search ..... 162/336, 343, 344, 208, 162/216, 339, 214, 317

[56] References Cited

U.S. PATENT DOCUMENTS

| | | | |
|---|---|---|---|
| 2,904,461 | 9/1959 | Washburn et al. | 162/216 |
| 3,092,538 | 6/1963 | Parker | 162/343 |
| 4,152,202 | 5/1979 | Deligt | 162/208 |
| 4,361,467 | 11/1982 | Bubik | 162/344 |
| 4,885,060 | 12/1989 | Beran et al. | 162/216 |

*Primary Examiner*—Karen M. Hastings

*Attorney, Agent, or Firm*—Dallett Hoopes

[57] ABSTRACT

In the absence of the conventional stock feeding box the stock is conducted down through a feed pipe to a nozzle which directs the stock onto a wire belt. The nozzle may be directed in a different direction from the movement of the belt so that shear occurs at the delivery point to the benefit of the finished product. From the preliminary belt or "wire", the stock is delivered to a paper machine. In one embodiment the fibers are conducted dry to the belt and a cooperating "dwarf" wire presses the dry stock into a sheet. Booster heads are used to direct additional feed in a way which intercepts the main feed and breaks up micro-agglomerates. In one version the wire is stationary and the feed nozzle moves.

4 Claims, 6 Drawing Sheets

FIG. 2

NO-BOX SYSTEM WITH BOOSTER HEAD SPRAY FOR DELIVERING PAPER STOCK TO A PAPER MACHINE

CROSS-REFERENCES TO OTHER APPLICATIONS

This application is a continuation-in-part of U.S. patent application Ser. No. 07/341,843, filed Apr. 24, 1989, now abandoned.

BACKGROUND OF THE INVENTION

1. Field of the Invention

This invention relates to an apparatus and method for delivering paper stock to a paper machine More specifically this invention relates to apparatus including a preliminary moving wiremesh belt to which the stock is projected under pressure from above. Spaced down the wire-mesh belt is means for removing the drained stock from the belt and bridging it over to the paper machine. The invention also relates to the method of projecting a paper stock down onto a moving wire-mesh belt to create a shearing effect that makes a high-quality paper product.

In some versions of the invention the belt is moving and the projector is stationary; in other versions the belt may be stationary and the projector may be moving. Similarly, the projector may aim the stock in the direction opposite the movement of the belt; in others the projector may be aimed in the same direction.

2. Description of Related Art Including Information DisClosed Under §1.97 & 1.99

On the inlet side of a paper machine there have been various head-box designs to form the paper sheet on the wire-mesh belt or "wire belt" or "wire" as it is called in the trade. These headbox designs are traditionally divided into the following main classes:

(a) low pressure head-boxes (b) high pressure head-boxes

These were then developed into a multitude of semi- or fullhydraulic designs, such as multilayer head-boxes
high-turbulence head-boxes
controllable multi-channel head-boxes
bunch tube head-boxes
step diffuser head-boxes
step flow head-boxes
converflow head-boxes in which all of some basic details are almost the same, e.g.

manifold tubes
impact plates/turbulence plates
perforated rollers
flow chambers
lip units
control and measuring instruments The well-known technical characteristics are then adjusted to get the stock flow (of pulp etc. fibers) under good control. Notwithstanding this it is anyway impossible to reach a consistent optimum functioning because of the variations in the process conditions and the temperamental nature of the various designs. This has led head-box designing to become more an art than a science, an art in which the structure is not necessarily based on facts but on traditions.

New head-boxes were often developed only for the purpose of creating a new design category with total absence of any underlying sensible reason.

At any rate, the main purposes of the head-box or any other sheet former are the following e.g.

the prevention of the stock/fiber agglomeration
the creation of proper conditions for a defect-free sheet formation
the conversion of the (turbulent) pipeline-flow into an evenly spread stream which can be applied onto the wire In spite of the elaborate conventional head-box designs, several difficulties arise due to the inability at the head-box itself (or in the so-called short circle, including pipeline with screeners and hydra-cleaners) to deal with various factors:

the stock variation along the paper machine (longitudinal) or across the paper machine
all sorts of paper specifications in a wide range
agglomeration of fiber
foaming
restrictions of paper machine speeds
uncontrolled behavior and adjustment difficulties
capacity problems
corrosion (With regard to capacity problems, the speed of a modern paper machine is usually between 200 . . . 1600 m/min. In higher machine speeds the head-box has always been a limiting factor, the faults in the sheet formation caused by the head-box cannot be repaired at the paper machine.)

The prior art has not really come to grips with these problem areas.

SUMMARY OF THE INVENTION

Because the modern head-boxes with auxiliaries are quite expensive equipment, as well as not reliable to deal with the above problems, the primary aim in developing the present system has been to abandon the traditional notion of the indispensability of a head-box. It was thus determined to develop a new apparatus for optimum sheet formation and to proceed open-mindedly as though a head-box might not be necessary.

In this "NO-BOX" thinking I reverted to the origins of paper making only in a more elegant version. (In the early days there were no head-boxes at all or merely an open "container" to equalize the flow.) At the same time my goal was to design a head-box substitute which would be easily controlled, even manually if needed, or be controlled with the normal process control devices. In this manner the whole operation would be adjustable continually and at every moment meet the demands coming from the paper machine to the optimum so that the sheet would always be acceptable and better quality paper could be made.

In the present invention the paper stock is conducted towards the wire from a selected direction and under various pressures and speeds in a confined path to be projected in a spray- or jet-form to spread against the wire-mesh belt preliminary to the paper machine itself The confined path is in the form of a feed pipe and nozzle. The pipe has mixing means and laminator plates thereinside. After the nozzle and adjacent the wire belt there may be appropriate spreaders and lips. The belt may include a vibrator unit. From the preliminary wire-mesh belt the relatively dry slurry may be removed for delivery to the paper machine either in direct line or at a right angle (or "side feed").

In one modification (dry forming of the sheet) a second wire-mesh belt operating above and over the preliminary belt may assist in the shaping of stock.

The angle of the feed pipe may be adjusted as may other components of the apparatus including belt speed by electric process control to optimize the product.

The invention has other embodiments.

BRIEF DESCRIPTION OF DRAWINGS

Other objects and features of the invention will be apparent from a study of the following specification and the drawings, all of which relate to non-limiting embodiments of the invention. In the drawings:

FIG. 1A is a fragmentary view showing a modified form of a portion of the apparatus and related to the dry forming of the sheet.

DESCRIPTION OF THE PREFERRED EMBODIMENT

Figure 1:
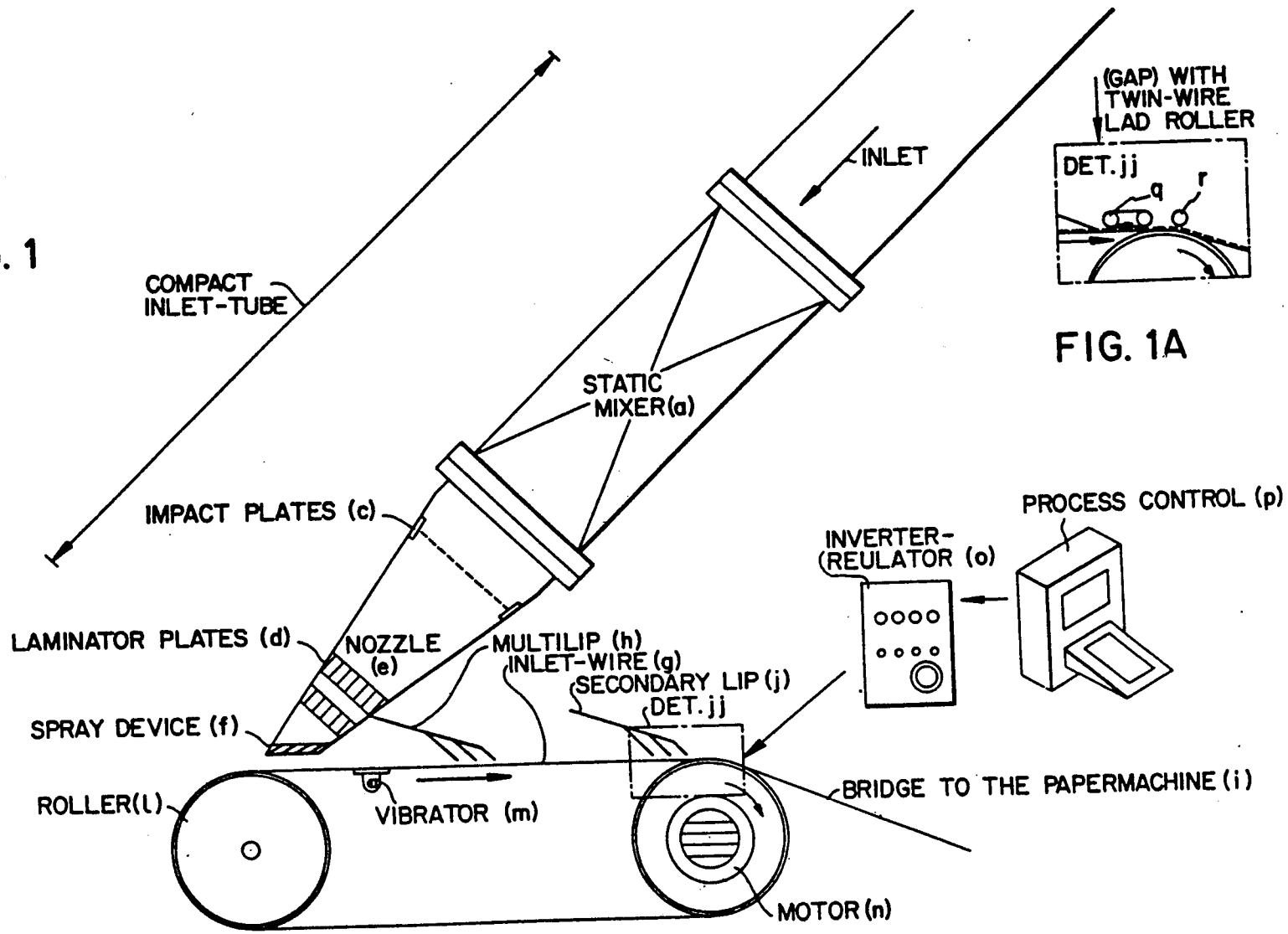
FIG. 1 is a schematic elevational view of an apparatus embodying the invention.

FIG. 1 shows a NO-BOX preliminary wire-mesh belt system with spreader and spray arrangements. In FIG. 1 the tubelike inlet pipe comes from above in an angle. The angle is chosen from case to case to suit the type of sheet formation proposed. The direction opposite to the direction or the movement of the feed wire belt (shown in FIG. 1) is merely an example of the extreme directional change with maximum shearing effect.

In the inlet-tube there are the static-mixer followed by the impact plates (c) and the laminator plates (d).

The machine end of the inlet-tube expands laterally into a sprayer-jet outlet (f) which can also consist of multi-jets or multi-nozzles. With this arrangement the stock of fibers can be spread on to the wire-mesh belt as a form of a spray. This gives the sheet the wanted properties, e.g. homogeneity etc. The intensity and fineness of the spray (spray-pressure) can be altered from low to high depending on the pumping pressure and inlet angle. In using many outlets with a fine spray, a multilayered paper product can be made.

The sheet pre-formation is made on the inlet-wire or belt (g) which includes a lip (h) or multi-lip device, usually placed onto the middle of the belt. After this comes the bridge (i) to the paper machine and the bridge lip, which can also be of multi-lip type. The multi-lip device consists of several lips working close to each other. The lip can be installed to whatever desired place in the NO-BOX System.

In the case of dry-forming (FIG. 1*a*) the system uses instead of the lip a press belt g positioned above the belt g with a very close gap to form the sheet. The press belt or "dwarf wire" presses the dry-stock into a sheet. The press belt can be followed by a secondary roller r with a smooth surface for doing the "calendaring" or "polishing" or "finishing" of the sheet. In the dry-forming process, the wire shown is not followed by the usual paper machine.

The other parts of the NO-BOX System are:

the belt of the continuous inlet-wire (g)

the end rollers (l)

the vibra-unit ( m) for the belt (ultrasonic unit)

the motors for the rollers (n)

the inverter unit/regulator unit (o)

the control units of the process (p)

The vibrator unit (m) secures a smooth sheet formation on the wire-mesh belt and also gives a defoaming effect.

In operation the fiber stock consistency is usually given as ca. 0.5%, but it can be lower and even considerably higher. If it is 1% or over, the NO-BOX System is not plagued with same difficulties as head-boxes, namely bad flow, agglomeration and foaming due to air.

The stock comes from above to the impact plates c. The agglomerates are disintegrated, and the laminator plates rectify the flow so that it can be spread evenly and remove the turbulence at the same time or in the secondary laminator phase.

The previous parts (i.e. the impact plates c and laminator plates) in the inlet tube can be left out if a lever blade (FIG. 2A) is used in front of the spray head.

The stages prepare the stock flow which is then directed to the spreader-jet (under pumping pressure) from which it can be sprayed or simply "dropped" onto the running belt (wire). This ensures an even spreading longitudinally and across the belt. The possible unwanted "micro" agglomerations can be smoothed out with the lip-pressure and the vibra-unit.

When the belt is running in the opposite direction from the incoming direction from the pipe a (or the flow is coming sidewise or in an angle), there exists a maximum speed-differential between the flow coming out of the spreader and the running belt. This causes a shear effect between the stock fibers and the belt. Thus a high-quality sheet is formed already on the preliminary wire-mesh belt. This can be led over the bridge to the paper machine (the mother machine)

The typical dimensions of the pulp fibers are:

length 1 to 5 mm the length/diameter-ratio 30 to 200

The system can be used without the inlet-wire (g) so that the spray is applied directly to the paper machine.

Figures 2, 2A, 2B:
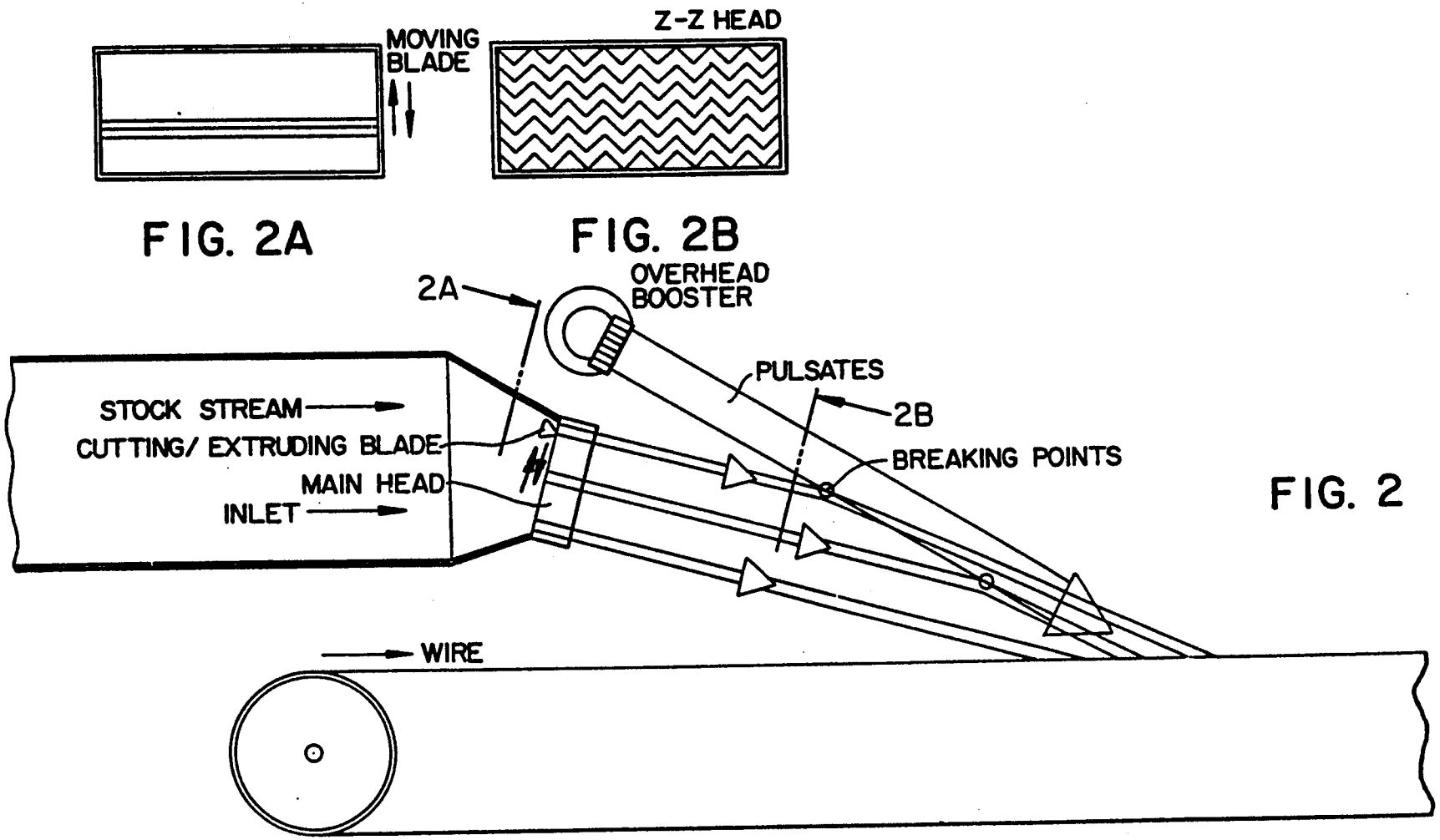
FIG. 2 is a schematic elevational view of a further embodiment which is used in the case of making a multiply paper product.
FIG. 2A is a sectional view taken on the line 2A—2A of FIG. 2.
FIG. 2B is a sectional view taken on the line 2B—2B of FIG. 2.

The modification shown in FIG. 2 includes the delivery nozzle with its stock stream outlet aimed in the same general direction as the moving belt. The stock stream comes in through a conduit which may be circular in cross-section and is narrowed down by a transition piece to a rectangular main head. The head has a transverse plate with zig-zag slits in it as shown in FIG. 2B and on its upstream side the plate is provided with a moving blade to clean off fibers as they pass through the openings in the head.

As shown (FIG. 2), the stock emanates from the head in separate streams to impact on the wire in a plurality of positions on the wire to produce corresponding layers as shown.

Above the main head is a transverse high pressure stock line called an "overhead booster" which terminates in booster outlets which direct the stock also down toward the belt in a stream which may be made to pulsate. A purpose of the booster is to maximize a spreading to the stock on the wire. The flow from the overhead booster outlets intercepts the flow from the main head at break points as shown in the air above the belt to deflect the main head effluent down toward the belt. This breaks up the possible micro-agglomerations and speeds the spray to positions which meet the specifications of the paper being made. The booster stock line is preferably of the same stock as the main stock line Alternatively it may be a line of water, air or any convenient booster material. While the booster outlets normally are stationary, they may be made to oscillate if desired or necessary For that matter, either the main line or the booster line, or both can be pulsated.

Figures 3, 3A, 3B:
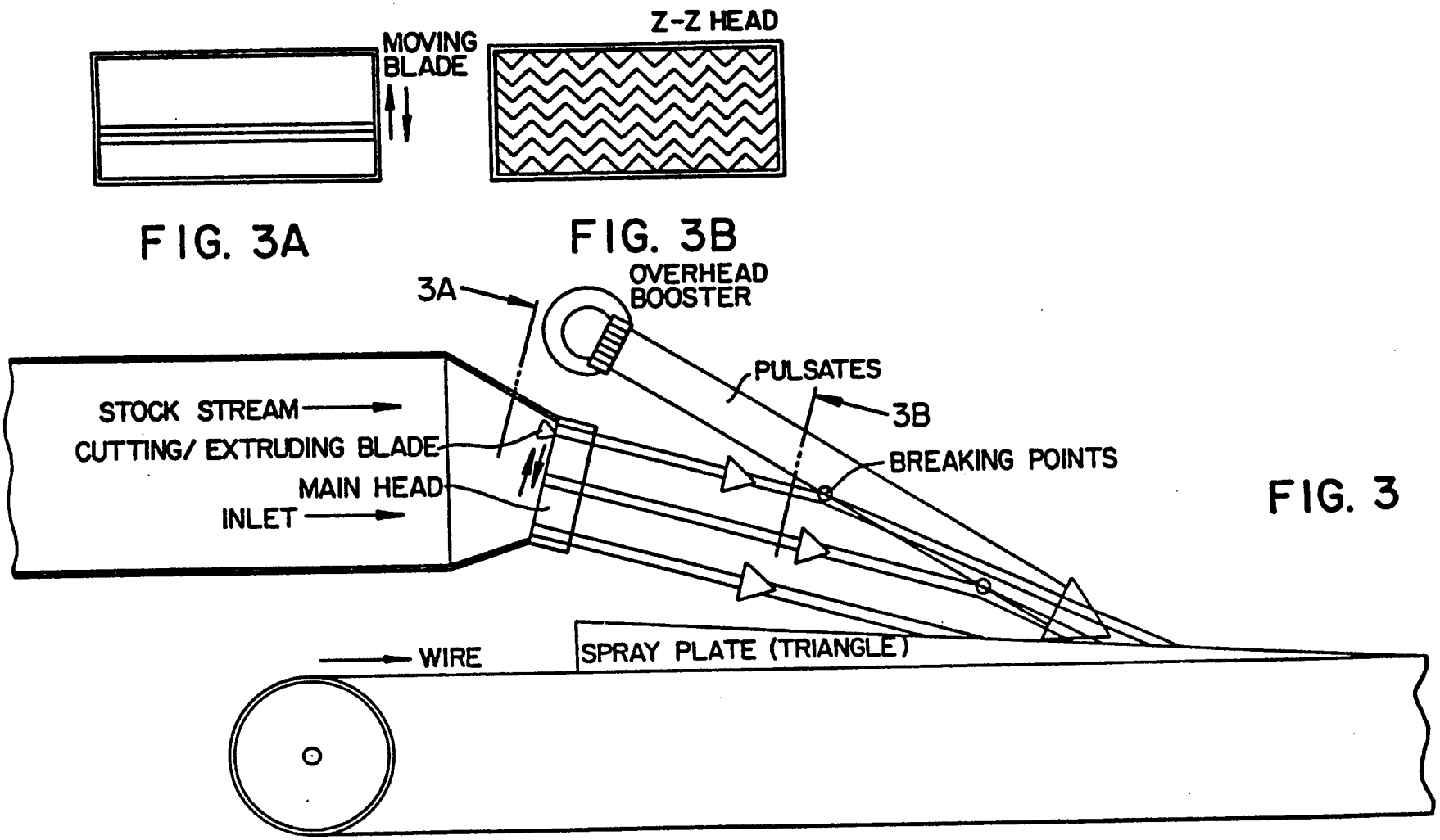
FIG. 3 is a schematic elevational view of a further embodiment.
FIG. 3A is a sectional view taken on the line 3A—3A of FIG. 3.
FIG. 3B is a sectional view taken on the line 3B—3B of FIG. 3.

FIG. 3 shows a further modification in which a spray plate which is disposed across the top of the moving belt provides an incline down which the effluent from the main head and the overhead booster may be directed in a sheet flowing onto the moving belt.

Figures 4, 4A, 4B:
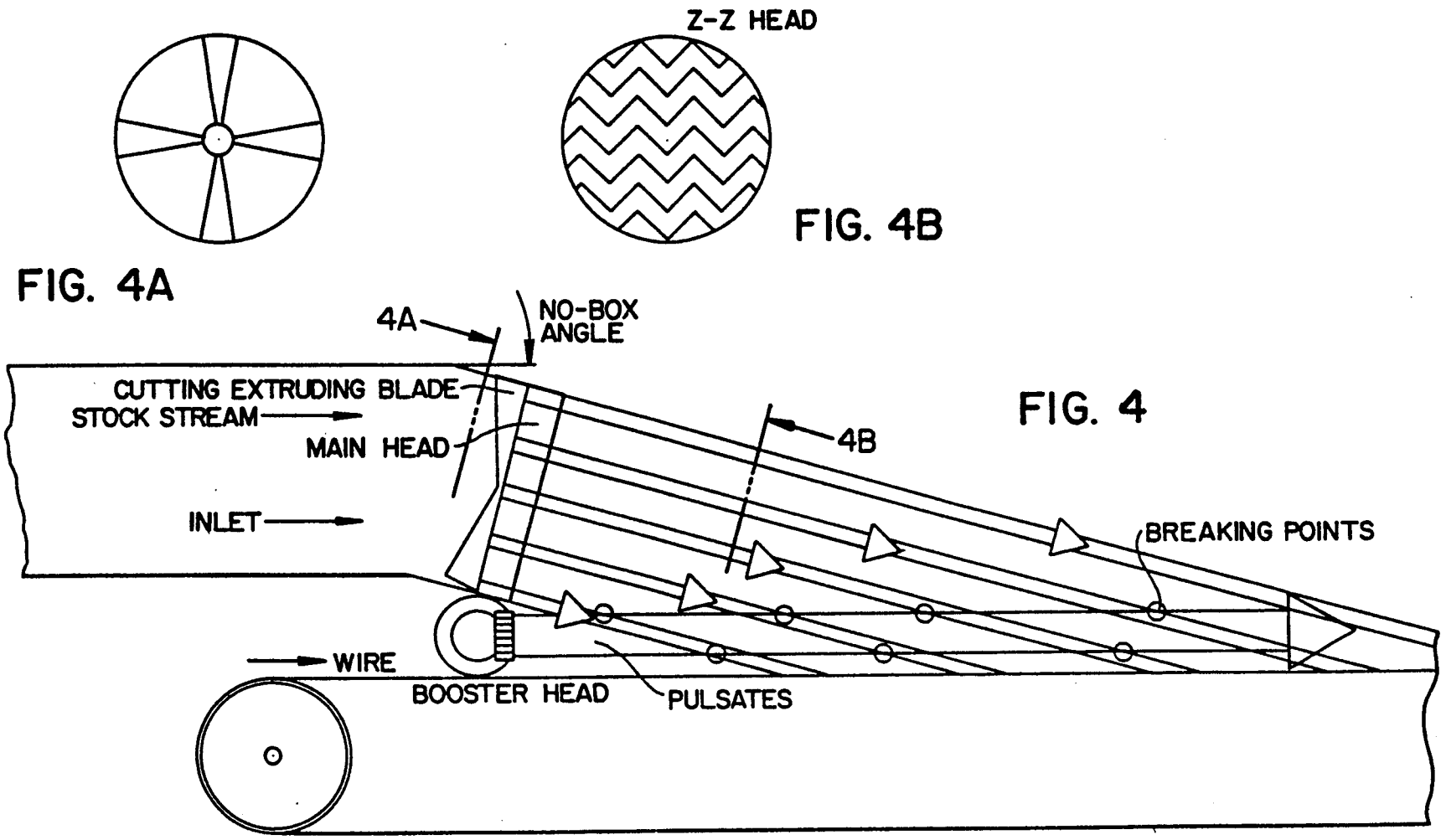
FIG. 4 is a schematic elevational view of a still further embodiment.
FIG. 4A is a sectional view taken on the line 4A—4A of FIG. 4.
FIG. 4B is a sectional view taken on the line 4B—4B of FIG. 4.

FIG. 4 shows an additional modification in which the main head is circular and a cutting or extruding blade rotates on the upstream side of the head outlet to clean off fibers passing through the head openings Again, FIG. 4B shows the spray pattern attributable to the action of the main head. In the FIG. 4 embodiment the booster head is beneath the main head and jets of stock forward to intercept the jets from the main head. Again, the purpose of the booster head is to break up the possible micro-agglomerations and to speed the spray to every possible specification requirement.

Figure 5:
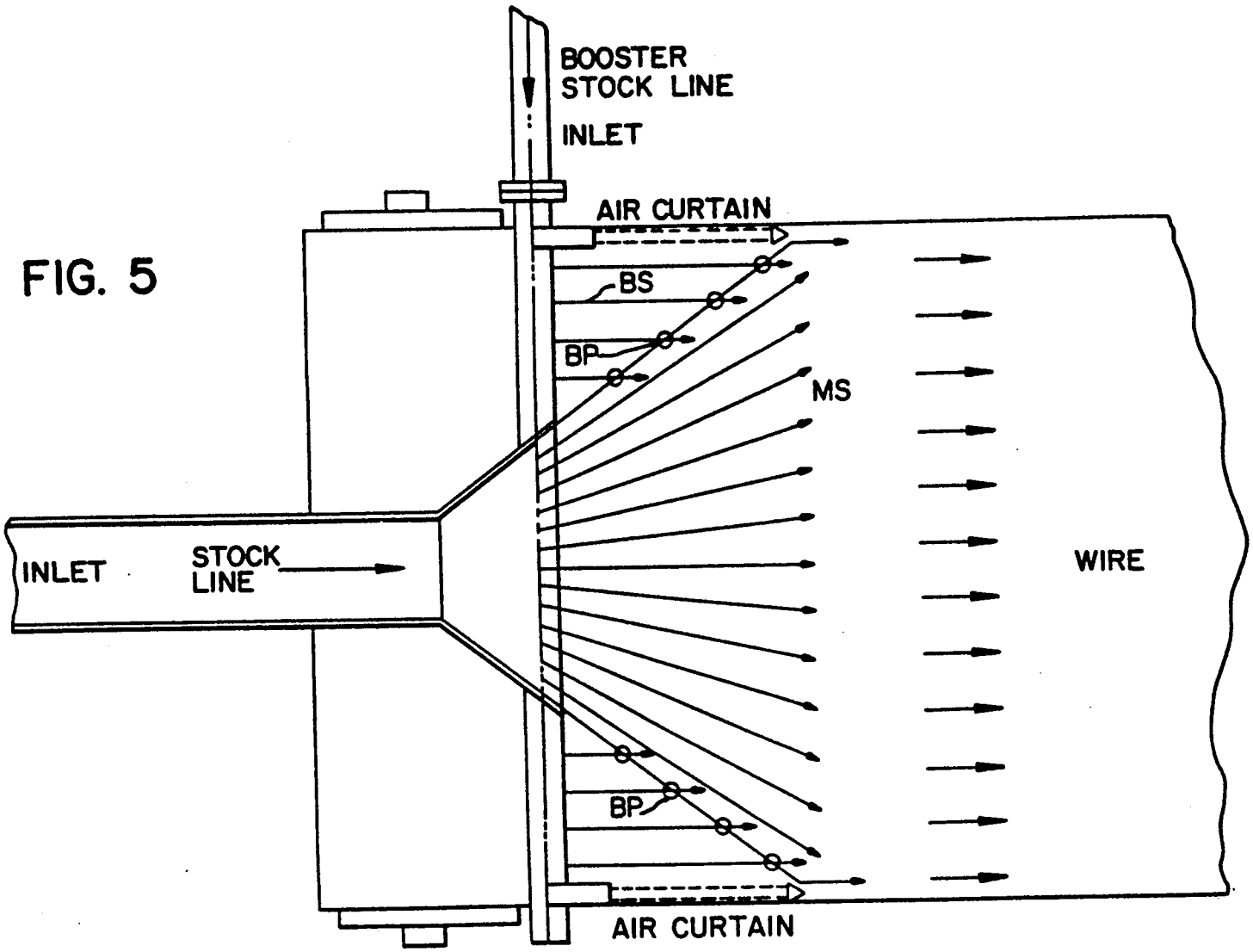
FIG. 5 is a top plan view of a still further embodiment.

FIG. 5 is a top view showing the main head when the main spray MS and the booster spray BS are showing the interception of these two streams at breakpoint BP.

At the margins of the belt, along its edges there are imposed air curtains as shown for the purpose of limiting the edgewise expanse of the main head flow. This serves to keep the stock on the belt. Aside from air, the curtain may be a flow of water or even stock from the booster line as shown.

The NO-BOX System will not be affected by the variation in the stock consistency or variation of the fiber dimension and allows even higher machine speeds than given here or higher than the speed of any existing paper machine.

Figure 6:
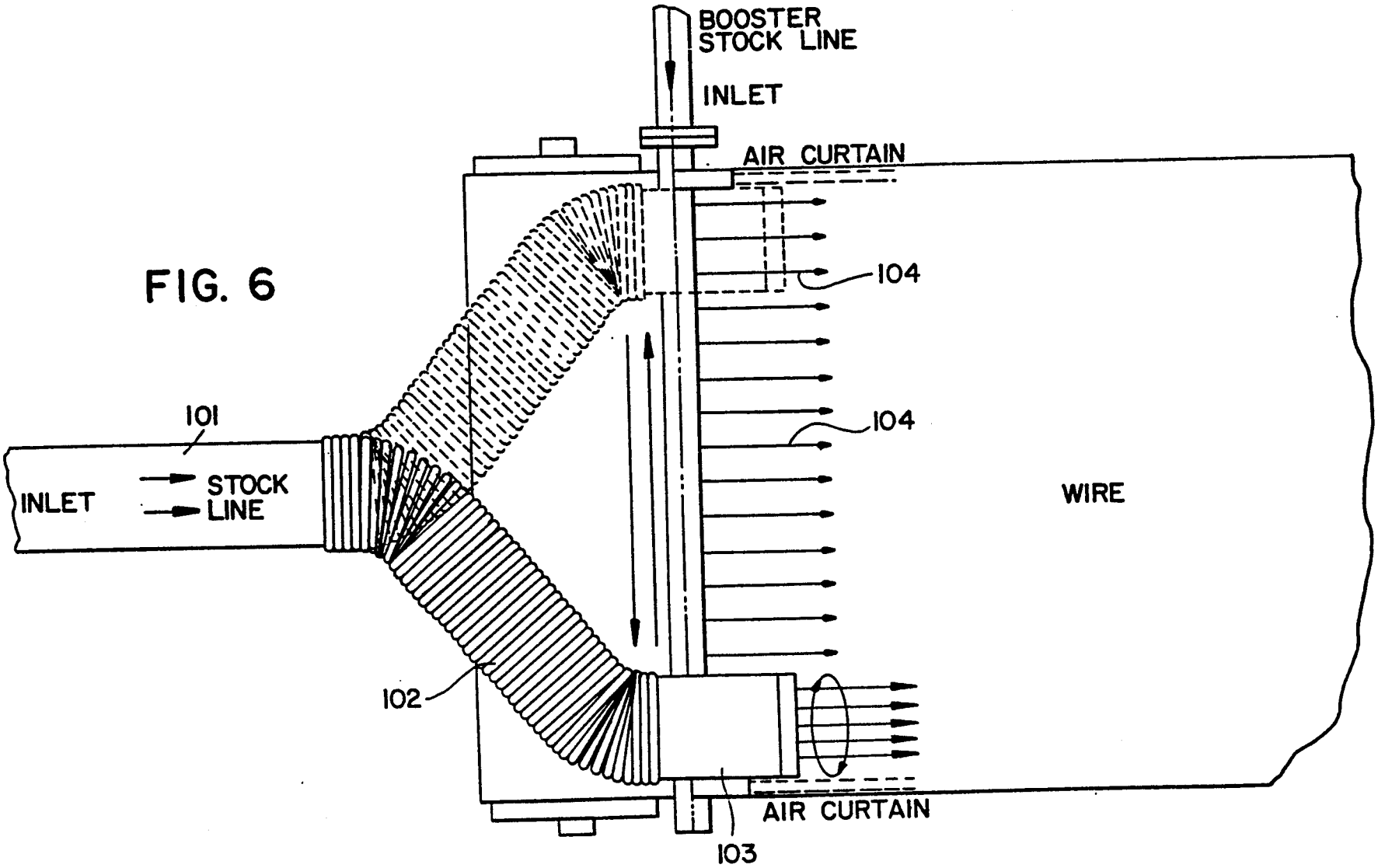
FIG. 6 is a top plan view of a still further embodiment.

The NO-BOX System can also work on the basis that the NO-BOX spray head is moving upon the wire and the wire itself stays stationary. This would be the opposite to the traditional paper machines. An example of this arrangement is pictured in FIG. 6 wherein the stock is delivered from a rigid stock line 101 through a flexible hose 102 to a reciprocating spray head 103 which reciprocates back and forth above the traveling wire, as shown. The flow from the traveling spray head may be intercepted by jets 104 from the booster line.

NO-BOX System uses up to or more than 100% higher jet pressures than head boxes. Spray/jet-head or main feed outlet can be combined with rotating blade which automatically cleans the head. The jet head may be a combined spreading head and a high pressure booster head, the latter giving the spray an exceptional speed and crosses the main spray.

The NO-BOX System based on the preliminary wire-mesh belt or inlet-wire can be at every instant adjusted to meet the optimum, if modern process control instrumentation o and e is used. This goes especially for the Twin-Wire arrangement (FIG. 1*a* related to the dry-forming of the sheet), where the gap and angles of the wires are adjustable. On the other hand, the control is so simple that the system parameters can be found without difficulty also manually. In this case the price of the expensive control apparatus can be saved.

Thus while I have disclosed the invention in only one embodiment, the invention is not so limited but may be defined as having the scope of the following claim language or fair equivalents thereof.

What is claimed is:

1. An apparatus for making paper comprising:

a a pair of rollers horizontally aligned, b an endless wire-mesh belt trained over the rollers, the belt having an upper top surface.

c means for driving one of the rollers so that the top surface of the belt goes in a first direction, d a first pressurized conduit for delivering paper fiber stock to the belt, the first conduit being disposed above the belt and terminating in first nozzle means spaced above the belt and adapted to disperse the stock over the upper top surface of the belt, and e a second pressurized conduit having second nozzle means spaced above the belt and delivering stock toward the belt in the same general direction as the first nozzle means, said first and second nozzle means are structured and arranged so that their discharge streams forceably and violently intercept each other at points in the air above the belt and spaced from the first and second nozzle means to break up microagglomerations and spread the stock across the belt.

2. An apparatus for making paper as claimed in claim 1 wherein the second nozzle means is located above the first nozzle means.

3. An apparatus for making paper as claimed in claim 1 wherein the second nozzle means is located below the first nozzle means.

4. An apparatus for making paper as claimed in claim 1 wherein the first nozzle means comprises a transverse plate having a plurality of openings in it and a blade adapted to move across the side of the plate facing away from the belt to cut off fibers.

* * * * *